United States Patent [19]

Remick et al.

[11] 4,232,492

[45] Nov. 11, 1980

[54] DRYING APPARATUS FOR MULTI-GLAZED WINDOW UNIT

[75] Inventors: David W. Remick, Camillus; David T. Ahlgren, Syracuse, both of N.Y.

[73] Assignee: O. M. Edwards Co., Syracuse, N.Y.

[21] Appl. No.: 4,459

[22] Filed: Jan. 18, 1979

[51] Int. Cl.[3] ..... E06B 7/12

[52] U.S. Cl. ..... 52/172; 52/788; 428/34

[58] Field of Search ..... 52/172, 788, 790; 428/34

[56] References Cited

U.S. PATENT DOCUMENTS

| | | | |
|---|---|---|---|
| 2,276,112 | 3/1942 | Stoneback | 52/172 |
| 2,964,809 | 12/1960 | Gwyn | 52/172 |
| 3,001,249 | 9/1961 | Elton | 52/172 |
| 3,203,053 | 8/1965 | Lane | 52/172 |
| 4,074,480 | 2/1978 | Burton | 52/172 |

FOREIGN PATENT DOCUMENTS

| | | | |
|---|---|---|---|
| 579793 | 6/1958 | Italy | 52/172 |
| 313126 | 3/1956 | Switzerland | 52/172 |
| 515085 | 11/1939 | United Kingdom | 52/172 |

*Primary Examiner*—James A. Leppink
*Assistant Examiner*—H. E. Raduazo
*Attorney, Agent, or Firm*—Bruns & Jenney

[57] ABSTRACT

A multi-glazed window unit of the type wherein parallel panes of a light transmitting material are sealed in a spaced apart relationship and the atmosphere between the sealed panels is treated to remove moisture therefrom. A housing containing a desiccant is positioned between the sealed panes along one outer edge of the unit. The housing is divided into two zones, the first zone being open to the atmosphere so that any moisture present in the atmosphere at the time the unit is sealed is immediately removed therefrom by the desiccant in this zone, and a second zone that is shielded from direct exposure to the atmosphere whereby the desiccant in this zone remains in a condition to remove moisture from the atmosphere which may penetrate the seal at a later time.

4 Claims, 3 Drawing Figures

DRYING APPARATUS FOR MULTI-GLAZED WINDOW UNIT

BACKGROUND OF THE INVENTION

This invention relates to a multi-glazed window unit and in particular to a system for removing unwanted moisture from the sealed atmosphere between the light transmitting panels of the unit.

The most pertinent prior art known to the Applicants at the time of filing this application is embodied in the following U.S. Pat. Nos.:

1,860,273
2,021,468
2,680,269
2,964,809
3,803,784
3,868,299
3,990,429

As noted by Gwyn in the above-noted U.S. Pat. No. 2,964,809, it is highly desirous to place a desiccant or drying agent between the sealed panes of a window unit to remove any moisture from the system which might subsequently penetrate the window seals. As disclosed by Gwyn, the desiccant is initially mounted within the unit in a totally enclosed housing. After the unit has been assembled and sealed, the atmosphere between the panes is usually filled with dehydrated air or partially evacuated to hopefully eliminate the presence of moisture in this area.

As is well known, any moisture in the sealed atmosphere can condense upon the pane surfaces and thus have an adverse effect upon the heat transfer and image transmitting properties of the unit. To further protect his unit against unwanted moisture, Gwyn places a desiccant between the sealed panes of the unit. The desiccant is stored within an enclosed container that is opened after the unit is sealed by passing a fine drill through both the seal and the container. The hole in the seal is resealed, thus allowing the desiccant in the container to control any moisture that might somehow infiltrate the unit.

As evidenced by the Gwyn system, the use of a desiccant has proven to be an effective means for controlling the moisture build-up in a sealed multi-glazed window unit over a long period of time. However, most of the prior art systems are single purpose devices that are both difficult to install and to place in operation.

SUMMARY OF THE INVENTION

It is therefore an object of the present invention to improve multi-glazed window units.

A further object of the present invention is to provide a double-acting drying system for use in sealed multi-glazed windows that will remove the moisture from the sealed atmosphere immediately upon closing of the unit and also control the moisture build-up in the sealed region over a prolonged period of time.

Another object of the present invention is to provide a multi-function desiccant system containing a rapidly acting section and slowly acting section.

A still further object of the present invention is to provide a multi-purpose drying system that can be easily installed in a multi-glazed window unit and easily put into operation.

Yet another object of the present invention is to provide wide range moisture protection to a multi-glazed window unit in a simple and relatively inexpensive manner.

These and other objects of the present invention are attained by means of multi-glazed units having parallel panes of light transmitting material held in a spaced apart relationship and the atmosphere between the panes that are sealed in place to prevent moisture from passing into the unit, the unit further including a desiccant housing extending along one of the sealed margins of the unit having two individual sections or zones wherein the desiccant in the first zone is exposed to the atmosphere to immediately remove moisture from the atmosphere upon sealing of the unit and a second zone in which the desiccant is shielded from direct exposure to the atmosphere whereby the desiccant in this zone remains in a condition to remove any moisture from the atmosphere which may later penetrate the seals.

BRIEF DESCRIPTION OF THE DRAWINGS

For these and other objects of the present invention reference is had to the following detailed description of the invention which is to be read in conjunction with the accompanying drawings, wherein.

DISCLOSURE OF THE INVENTION

With reference to the drawings, there is shown a double glazed window unit, which is generally referenced 10, that includes a front light or pane 11 and a second rear light or pane 12. The window panes can be constructed of any light transmitting material, such as glass or plastic, as is typically employed in this type of unit. It should be further noted that although the invention will be herein described with particular reference to a double glazed unit, the invention is not limited to this specific structure and the invention can be utilized with equal effectiveness in a window unit having any number of panes.

Figure 1:
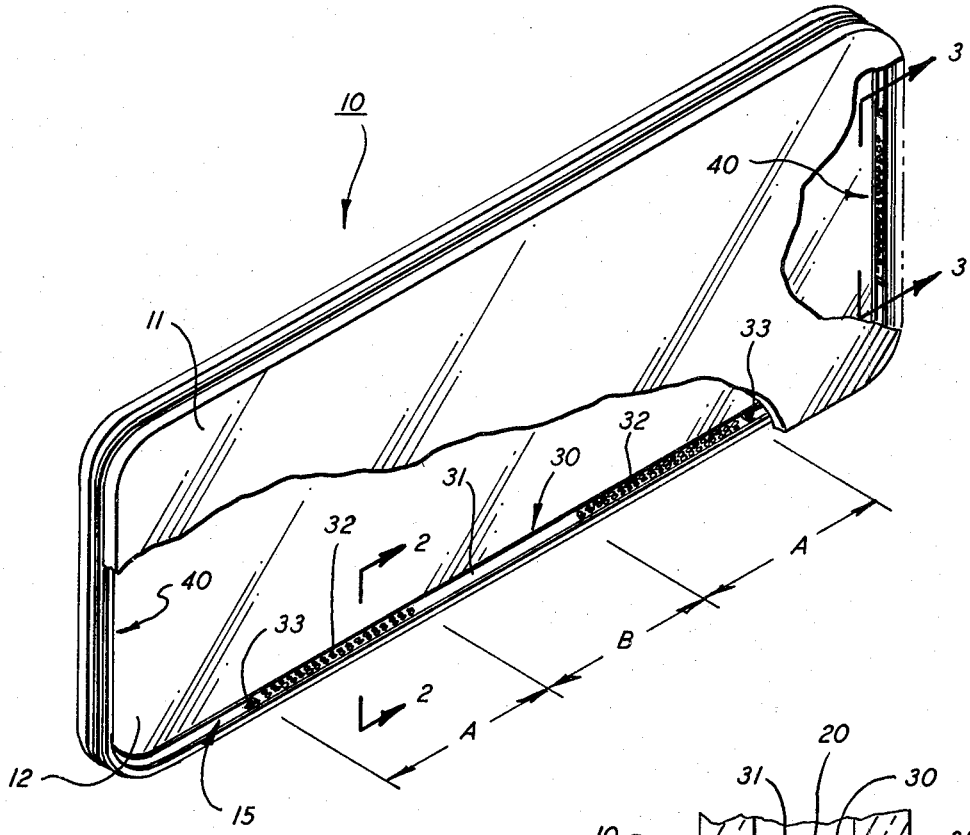
FIG. 1 is a perspective view of a double glazed window unit having portions broken away to expose a desiccant system embodying the teachings of the present invention.
Figure 2:
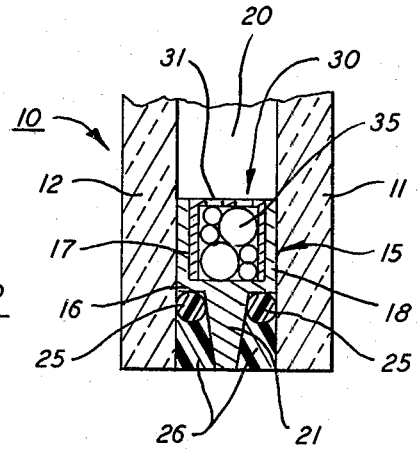
FIG. 2 is a section taken along lines 2—2 in FIG. 1 showing the sealing mechanism and the desiccant housing utilized in the present unit.
Figure 3:
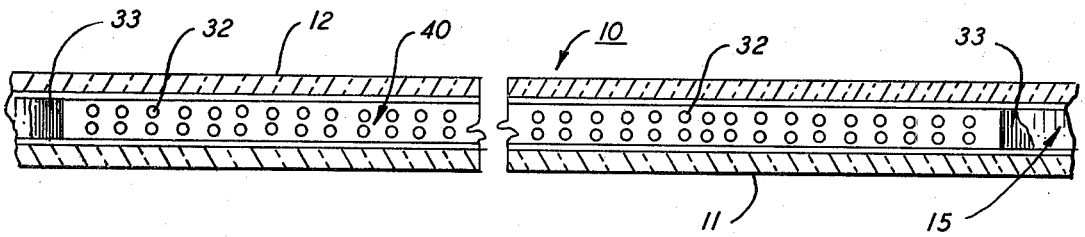
FIG. 3 is a view taken along lines 3—3 in FIG. 1 showing the construction of an auxiliary desiccant housing that may be used to enhance the rapid drying characteristics of the present invention.

As seen in FIG. 1, the present unit 10 is basically rectangular in form. The two panes 11 and 12 are both planar elements of similar construction conforming to the rectangular configuration. The panes are supported in spaced apart parallel alignment by means of a channel-shaped member 15 (FIG. 2). The channel member is positioned between the panes with the base 16 of the channel being normal to the inner sidewall surfaces thereof. The legs 17, 18 of the channel extend inwardly from the base and are seated in contact with the adjacent surfaces of the pane. The channel, in assembly, compliments the geometry of the unit's outer perimeter and is basically a closed frame-like structure that is capable of being positioned between the two panes to define an air space 20 therebetween.

The raised legs of the channel are usually secured to the sidewall surfaces of the light transmitting panes by any suitable adhesive material to cojoin the elements in assembly. A centrally located divider 21 extends outwardly from the base of the channel member and partitions the outer periphery of the unit into two symmetrical open-ended compartments also extending about the perimeter of the unit. A round circular gasket 25 is seated in the bottom of each compartment. Typically the gasket is formed of a resilient silicone rubber that is deformably received in the more restricted bottom section of the compartment to form a seal about the channel to pane interface.

A seal 26 is also packed into each compartment over the gasket to completely fill the area between the panes. The seal is formed of any moisture impervious material capable of setting or curing in place to form a moisture barrier capable of preventing water or water vapor from passing from the surrounding ambient air into the sealed atmosphere of the unit. The sealing materials available today are highly effective in blocking the passage of moisture. However, there is always a possibility that some moisture might infiltrate the system over a prolonged period of continual usage. As noted, this unwanted moisture can condense on the window panes thereby adversely affecting the operation of the unit.

To overcome the adverse effects of moisture, a desiccant system is herein provided which is specifically designed to carry out two specific functions. Initially, upon sealing of the unit, the system immediately removes the moisture in the atmosphere between the sealed panes. At the same time, a portion of the desiccant is shielded from direct exposure to the atmosphere and thus retained for future use after the initial drying has been carried out. The system therefore is held in condition to remove any additional moisture that might penetrate the unit. This dual function system is contained within an elongated housing 30 that is recessed into the spacer channel opening as best illustrated in FIG. 2. The housing, in this case, is a U-shaped member that compliments the channel opening and is slidably received therein with a close-running fit. The sidewalls of the housing are arranged to position the top surface 31 of the housing in coplanar alignment with the top surfaces of the raised arms 17 and 18 of the spacer channel to establish a clean, flush asssembly located along the bottom margin of the unit. The housing is packed with a drying agent or desiccant 35 to completely fill the interior thereof. The two ends of the housing are closed with an epoxy resin 33 or any other suitable material for securing the housing to the channel. The top wall 31 of the housing is partitioned into sections or zones which include a central zone which is identified as region B in FIG. 1 and two outer zones identified as regions A.

In the outer regions, the top surface of the housing is perforated by a plurality of relatively small holes 32 to expose the drying agent contained therein directly to the sealed atmosphere. The top wall surface of the housing in the central region is unopened or blank and thus serves to protect or shield the drying agent in this region from direct exposure to the sealed atmosphere. The drying material in the enclosed region, however, communicates internally with the other two outer regions and therefore has the ability to absorb moisture that migrates through the open region into the closed region. However, this only occurs after the drying agent in the outer regions is used up.

Two secondary or auxiliary housings 40—40 are provided in this embodiment of the invention to assist or augment the drying power of the open zones contained in the main housing 30. The auxiliary housings are both structurally similar to the main housing and are mounted flush within the spacer channel along the side margins of the unit as shown. The top surface of each auxiliary housing is opened to the sealed atmosphere via holes 32 as previously described in reference to the main housing to expose the drying agent or desiccant contained therein to the atmosphere. The holes are sized in reference to the physical nature of the drying agent to prevent the drying agent from being passed out of the housing through the holes.

In assembly, the main housing and the auxiliary housings are packed with fresh desiccant just prior to being placed in the window unit. The unit is then quickly sealed whereupon the desiccant in the open regions of the housings immediately dries the atmosphere within the sealed unit. The moisture, however, cannot migrate into the enclosed region of the main housing and, as a result, the desiccant in this region retains its drying power for use at some later time. In the event moisture does penetrate the sealed unit, the unused desiccant will be able to effectively control the condition of the sealed atmosphere and thus provide for continuous and efficient service by the unit over an extended period of time. By maintaining the volume of the enclosed region of the main housing about one half that of the open region, satisfactory operation of the present system can be expected over the life of the window unit.

While this invention has been described with reference to the structure disclosed herein, it is not confined to the details as set forth and this application is intended to cover any modifications or changes as may come within the scope of the following claims.

I claim:

1. In a multi-glazed window of the type wherein at least two light transmitting panels are mounted in a frame in a spaced-apart relationship and the window is sealed to prevent moisture from entering the atmosphere within the space between the panels, the improvement comprising an elongated housing extending along one of the margins of the window within the sealed space between the panels, said housing having a bottom wall, side walls and end walls, a desiccant material evenly dispersed throughout said housing in sufficient quantity to initially dry the atmosphere within the sealed space between the panels upon sealing of the window and to maintain said atmosphere in a dry condition thereafter, a cover mounted upon the top of said housing having a first open zone containing a plurality of closely spaced holes for exposing the desiccant in this region of the housing to said atmosphere and a second closed zone having an unbroken surface for shielding the desiccant in this region from direct exposure to the atmosphere in the sealed space, and said open zone of the cover containing at least twice the area of the closed zone.

2. The improvement of claim 1 wherein said open zone is divided into two sections with the sections being positioned on either side of the closed zone.

3. The improvement of claim 1 wherein said closely spaced holes are of a size which will prevent the desiccant from escaping from the housing.

4. The improvement of claim 1 that further includes a channel member mounted about the periphery of the window between the panels which opens into the sealed space therebetween and having said housing located therein.

* * * * *